US009248489B2

(12) United States Patent
Nakamura et al.

(10) Patent No.: US 9,248,489 B2
(45) Date of Patent: Feb. 2, 2016

(54) PRESS-FORMING METHOD AND PRESS-FORMING APPARATUS

(75) Inventors: Tsuyoshi Nakamura, Tochigi (JP); Naohiro Wakayama, Tochigi (JP)

(73) Assignee: HONDA MOTOR CO., LTD., Tokyo (JP)

( * ) Notice: Subject to any disclaimer, the term of this patent is extended or adjusted under 35 U.S.C. 154(b) by 666 days.

(21) Appl. No.: 13/524,234

(22) Filed: Jun. 15, 2012

(65) Prior Publication Data

US 2012/0324974 A1 Dec. 27, 2012

(30) Foreign Application Priority Data

Jun. 27, 2011 (JP) ..... 2011-142143

(51) Int. Cl.
*B21D 22/22* (2006.01)

(52) U.S. Cl.
CPC ..... *B21D 22/22* (2013.01)

(58) Field of Classification Search
CPC ..... B21D 25/02; B21D 37/08; B21D 22/26; B21D 24/04; B21D 24/14; B21D 24/10; B21D 24/12; B21D 22/22; F16F 9/3221; F16F 2230/0005
USPC ..... 72/350, 351, 453.13, 295, 305, 306, 72/317, 308; 267/164, 124
See application file for complete search history.

(56) References Cited

U.S. PATENT DOCUMENTS

| | | | | |
|---|---|---|---|---|
| 3,443,412 | A * | 5/1969 | Nelson et al. | 72/348 |
| 4,026,533 | A * | 5/1977 | Hennells | 267/124 |
| 4,423,859 | A * | 1/1984 | Mueller | B21D 28/20 267/119 |
| 4,669,298 | A * | 6/1987 | Kono et al. | 72/453.13 |
| 5,187,966 | A * | 2/1993 | Seconde et al. | 72/329 |
| 5,241,849 | A * | 9/1993 | Baur | 72/351 |
| 6,032,504 | A * | 3/2000 | Onat | B21D 22/02 72/297 |
| 2004/0231398 | A1* | 11/2004 | Bliss | 72/481.1 |
| 2010/0018280 | A1* | 1/2010 | Maeda et al. | 72/358 |
| 2010/0236318 | A1* | 9/2010 | Kubo | B21D 22/02 72/358 |

FOREIGN PATENT DOCUMENTS

| | | |
|---|---|---|
| JP | 56-142818 U | 10/1981 |
| JP | 04-059133 | 2/1992 |
| JP | 4-178225 | 6/1992 |

OTHER PUBLICATIONS

Japanese Office Action with English translation dated Sep. 24, 2014, 9 pages.

* cited by examiner

*Primary Examiner* — Shelley Self
*Assistant Examiner* — Gregory Swiatocha
(74) *Attorney, Agent, or Firm* — Rankin, Hill & Clark LLP

(57) ABSTRACT

A workpiece is press-formed into a press-formed product in a single stroke using a punch and a die by grasping a first portion of the workpiece by a blank holder at a first timing in the single stroke, and grasping a second portion of the workpiece which is different form the first portion by the blank holder at a second timing in the single stroke which is different from the first timing.

2 Claims, 11 Drawing Sheets

TOP DEAD CENTER

GRASPING PARTS ON BOTH SIDES OF REAR SIDE

GRASPING PARTS ON PERIPHERAL EDGE OF FRONT SIDE

GRASPING PARTS ON PERIPHERAL EDGE OF REAR SIDE

PRESS-FORMING METHOD AND PRESS-FORMING APPARATUS

BACKGROUND OF THE INVENTION

1. Field of the Invention

The present invention relates to a press-forming method and a press-forming apparatus. More specifically, the present invention relates to a press-forming method and a press-forming apparatus capable of forming a workpiece by a punch and a die in a state where the workpiece is grasped by a blank holder.

2. Related Art

Conventionally, a draw-forming of a workpiece such as a sheet metal panel has been carried out by a punch and a die in a state where an end of the workpiece is grasped by a blank holder. The end of the workpiece grasped by the blank holder is unnecessary in a final product. Accordingly, a trimming process for cutting the end is carried out after a draw-forming process.

Herein, as the portion which is cut away by the trimming process (so-called a waste-margin) increases, the yield of material decreases. For example, in a case of forming a rear floor panel of a vehicle which includes a spare tire pan on a rear side thereof and in which a height position of the rear side end is different from a height position of a front side end and the workpiece is draw-formed in a state where the ends of the workpiece are simultaneously supported by the blank holder, the waste-margin on the rear side end becomes too large. Accordingly, the yield of material is significantly degraded. On this account, a forming technology for reducing the waste-margin and improving the yield of material has been developed.

For example, JP-A-04-178225 discloses a forming apparatus which includes an insert die and an insert punch. The insert die can move in a vertical direction relative to a die. The insert punch is arranged to oppose the insert die and can move in the vertical direction relative to a punch. In this forming apparatus, a draw-forming is carried out in a state where a rear side end of the workpiece is grasped by the insert die and the insert punch and a front side end of the workpiece is grasped by a blank holder preceding the die and the punch. Accordingly, the rear side end of the workpiece can be formed while being pressed and restrained at a height position different from the front side end thereof. As a result, the waste-margin on the rear side end can be reduced.

However, in recent years, from a viewpoint of improving a design and a crash-resistance property, an integration of panels has been promoted and thus the shape of a panel member becomes more complicated. For example, it is necessary to form a rear floor panel 100 of a vehicle, which has a plurality of stepped portions therein, as illustrated in FIG. 1. The rear floor panel 100 includes a spare tire pan 110 provided on a rear side thereof and an convex-concave 120 extending in a vehicle width direction between the spare tire pan 110 and a front side thereof.

However, according to the apparatus of JP-A-04-178225, since only one insert die and only one insert punch are provided, the apparatus can only manufacture a panel member having only one stepped portion. In addition, even if a plurality of insert dies and a plurality of insert punches are provided in the apparatus of JP-A-04-178225, since the workpiece is simultaneously grasped, a stroke length of a die-assembly becomes longer and thus the die-assembly is large-sized.

SUMMARY OF THE INVENTION

One or more embodiments provide a press-forming method and a press-forming apparatus capable of manufacturing a member having a plurality of stepped portions therein while avoiding an increase of a size of a die-assembly and improving a yield of material by reducing a waste-margin.

BRIEF DESCRIPTION OF THE DRAWINGS

FIG. 7 (A) is a perspective view of a workpiece when a press-forming is started. FIG. 7 (B) is a perspective view of the workpiece when a spare tire pan is formed on a rear side thereof. FIG. 7 (C) is a perspective view of the workpiece when an convex-concave extending in a vehicle width direction between the spare tire pan and a front side thereof is formed. FIG. 7 (D) is a perspective view of the workpiece when a convex part extending in the front and rear directions of a vehicle body is formed on an upper surface of the spare tire pan.

DETAILED DESCRIPTION OF THE EMBODIMENTS

An exemplary embodiment will be described by referring to the accompanying drawings. The embodiment and its modifications described herein are not intended to limit the invention but only described as examples, and all features or combinations of the features of the embodiment and the modifications are not always essential to the invention.

A press-forming apparatus 1 according to one exemplary embodiment is configured to form a rear floor panel 100 of a vehicle by a single stroke. The rear floor panel 100 includes a spare tire pan 110 provided on a rear side thereof and an convex-concave 120 extending in a vehicle width direction and provided between the spare tire pan 110 and a front side thereof, as illustrated in FIG. 1.

Figure 1:
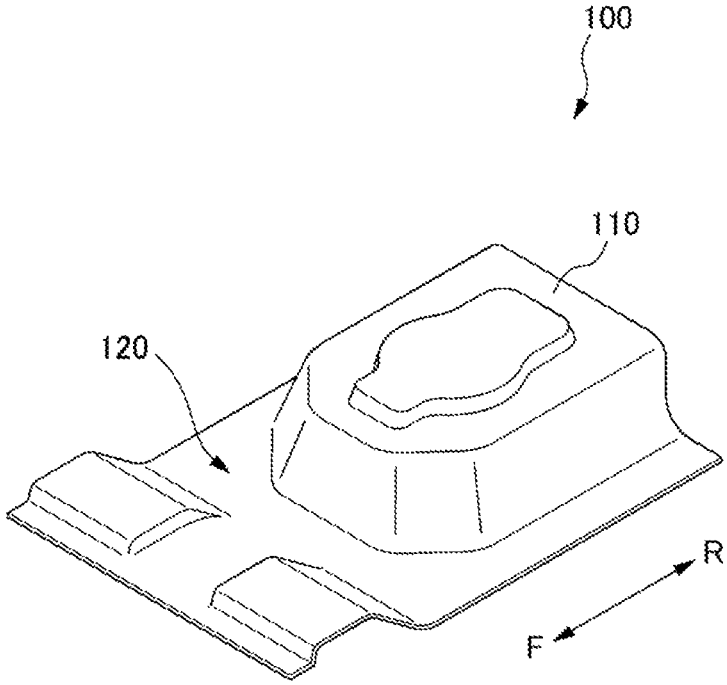
FIG. 1 is a perspective view illustrating a rear floor panel of a vehicle having a plurality of stepped parts therein.

The rear floor panel 100 is attached to a vehicle body in a state where an upper surface of the spare tire pan 110 illustrated in FIG. 1 is directed toward a lower side of the vehicle.

Figure 2:
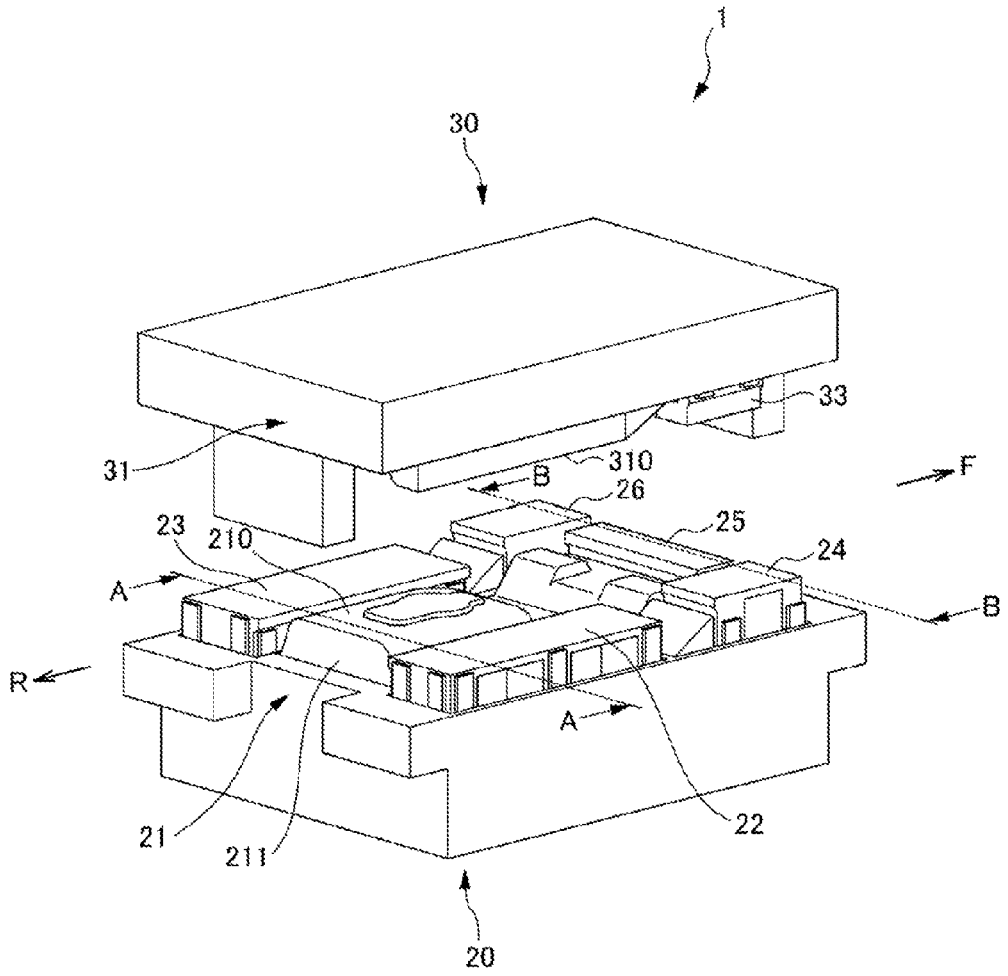
FIG. 2 is a perspective view illustrating a configuration of a press-forming apparatus according to one embodiment.
Figure 3:
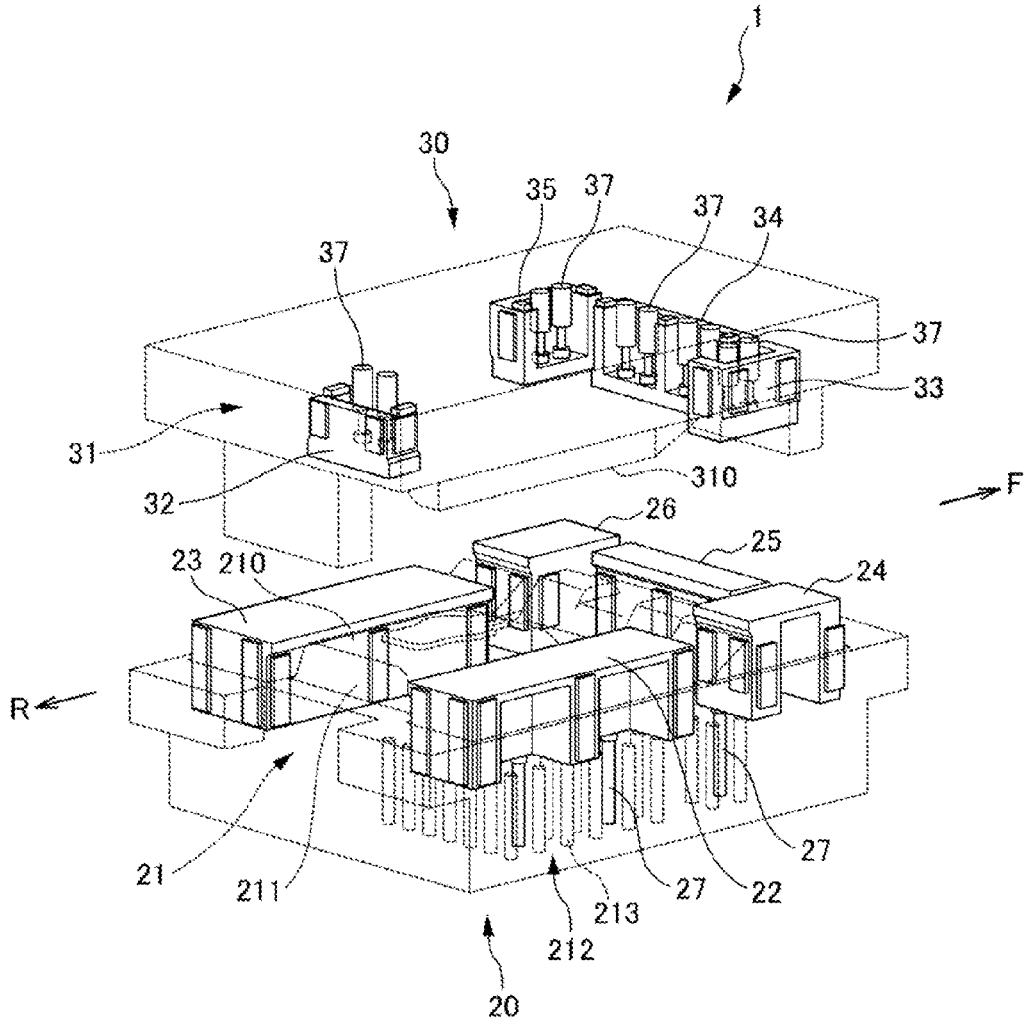
FIG. 3 is a transparent perspective view illustrating the press-forming apparatus according to the embodiment.

FIG. 2 is a view illustrating a configuration of the press-forming apparatus 1 according to an embodiment and FIG. 3 is a transparent perspective view illustrating the press-forming apparatus 1.

The press-forming apparatus 1 includes a lower die mechanism 20, an upper die mechanism 30 and a lifting mechanism (not illustrated). The lower die mechanism 20 is disposed below a steel plate (not illustrated) as a workpiece to support the steel plate. The upper die mechanism 30 is disposed above the steel plate to retractably move relative to the lower die mechanism 20.

The lifting mechanism is configured to lift the upper die mechanism 30.

The lower die mechanism 20 and the upper die mechanism 30 are arranged to oppose each other across the steel plate.

The lower die mechanism 20 includes a die 21 and a blank holder. The blank holder includes a first side holder 22, a second side holder 23, a first front holder 24, a second front holder 25 and a third front holder 26.

That is, although a conventional blank holder is integrally provided around a die, the blank holder according to the present embodiment is divided into a plurality of parts and each part is configured to move in a vertical direction independently of each other.

The die 21 includes a die body 211 and a die cushion mechanism 212.

The die body 211 is liftably supported by the die cushion mechanism 212. The die body 211 has a forming surface 210 of the same shape as the shape of the rear floor panel 100 illustrated in FIG. 1.

The die cushion mechanism 212 is arranged below the die body 211. The die cushion mechanism 212 includes a plurality of cushion pins 213 and a cushion pad (not illustrated) supporting the cushion pins 213.

The first side holder 22 and the second side holder 23 are arranged on both sides of the rear side (R side in FIG. 1 and FIG. 2) of the die 21. These side holders are disposed at a position which corresponds to both side portions forming leading end surfaces of a punch 31 (which will be described later). These side holders are supported by a plurality of gas springs 27 as a cushion to move vertically relative to the die body 211.

The first front holder 24, the second front holder 25 and the third front holder 26 are provided on an end of the front side (F side in FIG. 1 and FIG. 2) of the die 21. These front holders are supported by a plurality of gas springs 27 as a cushion to move vertically relative to the die body 211, as similar to the above side holders.

Each holder is supported on the gas springs 27 in such a way that an upper surface thereof is located over an uppermost surface of the die 21, in an initial state thereof (in a state where the upper die mechanism is located in a top dead center).

Further, in each side holder and each front holder, the stroke lengths thereof are set different from each other. Specifically, the stroke length of each front holder is set smaller than the stroke length of each side holder.

The upper die mechanism 30 includes a punch 31 and a blank holder. The blank holder includes a rear pad 32, a first front pad 33, a second front pad 34 and a third front pad 35.

The punch 31 has a forming surface 310 which is formed into a shape corresponding to the shape of the forming surface 210 of the die 21.

The rear pad 32 is provided in a central portion of the rear end of the punch 31. The rear pad 32 is arranged to oppose a projecting end of the rear side of the die 21. The rear pad 32 is supported by a plurality of gas springs 37 to move vertically relative to the punch 31.

The first front pad 33, the second front pad 34 and the third front pad 35 are provided on an end of the front side of the punch 31. The first front pad 33 is arranged to oppose the first front holder 24, the second front pad 34 is arranged to oppose the second front holder 25 and the third front pad 35 is arranged to oppose the third front holder 26. These front pads are supported by a plurality of gas springs 37 to move vertically relative to the punch 31, as similar to the above rear pad 32.

The rear pad 32 and each front pad are supported on the gas springs 37 in such a way that a leading end surface thereof is located over a leading end surface of both sides of the punch 31, in an initial state thereof (in a state where the upper die mechanism is located in a top dead center).

A configuration of the gas springs 37 provided on the rear pad 32 will be described in detail by referring to FIGS. 4 to 6. Meanwhile, the gas springs 37 provided on each front pad has same configuration and thus duplicated description will be omitted.

Figure 4:
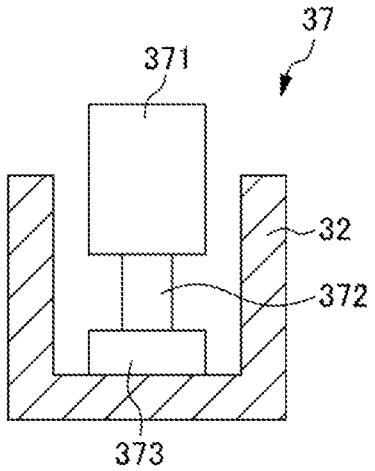
FIG. 4 is a schematic view illustrating a configuration of a gas spring in a front pad and a rear pad.

FIG. 4 is a schematic view illustrating the configuration of the gas springs 37. As illustrated in FIG. 4, the gas springs 37 includes a cylinder 371, a piston rod 372 and a plate 373 fixed to the rear pad 32. Further, the gas springs 37 includes a lock mechanism for locking the piston rod 372 in a bottom dead center thereof.

Figure 5:
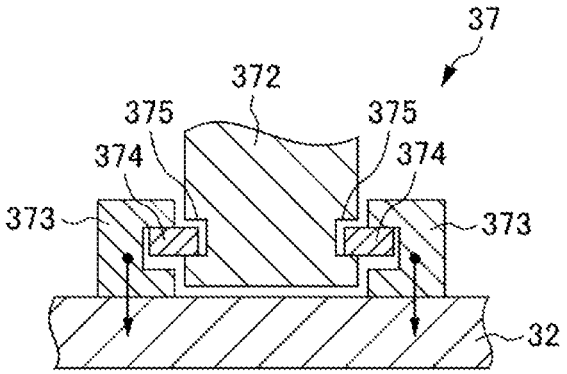
FIG. 5 is a sectional schematic view illustrating the gas spring.
Figure 6:
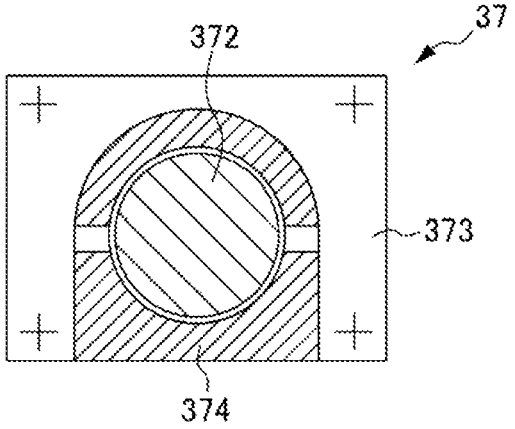
FIG. 6 is a top plan schematic view illustrating the gas spring.
Figure 7A:
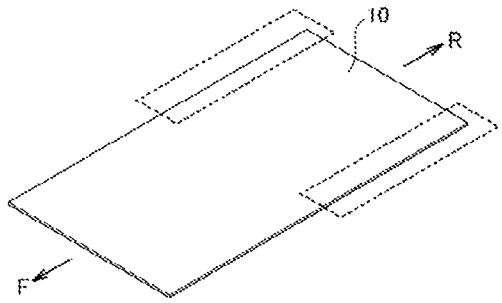
FIGS. 7(A) to 7(D) are views for explaining a press-forming method according to the embodiment.
Figure 7B:
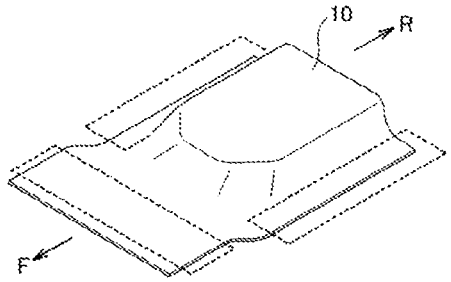
Figure 7C:
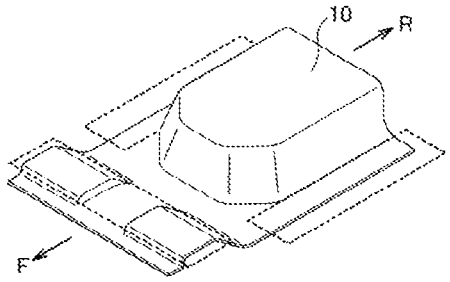
Figure 7D:
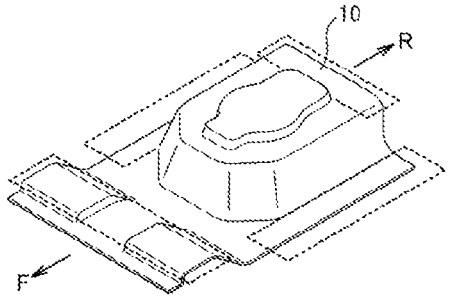

FIG. 5 is a sectional schematic view illustrating the gas springs 37. Further, FIG. 6 is a top plan schematic view illustrating the gas springs 37 of FIG. 5, as viewed from the top side thereof. As illustrated in FIGS. 5 and 6, the plate 373 is an annular plate which has a small diameter portion at an approximately central portion in a vertical direction. Further, a circumferential groove 375 is provided on an outer peripheral surface of a leading end of the piston rod 372. A retainer ring 374 is disposed between the small diameter portion of the plates 373 and the groove 375 of the piston rod 372. As illustrated in FIG. 6, the retainer ring 374 is composed of two parts and thus can be easily assembled.

Conventionally, a gas spring having a lock mechanism has been used as a gas spring provided on the pad of the upper die mechanism. However, in order to prevent the pad from falling down due to a weight thereof at the time of lifting the upper die mechanism (ram), a cylinder for urging the pad upward is separately provided. On this account, the structure of the die-assembly becomes complicated and a plurality of cylinders is provided. Accordingly, there was a problem that the size of the die-assembly becomes larger.

On the contrary, the gas springs 37 of the present embodiment can transmit a lifting load to the rear pad 32 via the plate 373 and the retainer ring 374 by using a simple and inexpensive structure as mentioned above. In this way, a cylinder for urging the pad upward as in the prior art is not necessary. Accordingly, even in a case where a plurality of pads is provided, there is no case that the size of the die-assembly becomes larger.

A press-forming method using the press-forming apparatus 1 thus configured will be described by referring to FIGS. 7(A) to 7(D). FIGS. 7(A) to 7(D) are views illustrating a forming sequence of the press-forming method according to the present embodiment. In FIGS. 7(A) to 7(D), the region enclosed by the dashed line represents a part which is grasped by the blank holders.

FIG. 7 (A) is a perspective view of a steel plate 10 as a workpiece when a press-forming is started. As illustrated in FIG. 7 (A), both ends of the spare tire pan in a vehicle width direction, that is, only both sides of the rear side of the steel plate 10 are grasped by the blank holder and then firstly formed when a press-forming is started. Specifically, both sides of the rear side of the steel plate 10 are respectively grasped by the first side holder 22 and the punch 31 and the second side holder 23 and the punch 31.

FIG. 7 (B) is a perspective view of the workpiece when the spare tire pan is formed on a rear side thereof in accordance with the lowering of the upper die mechanism 30. As illustrated in FIG. 7 (B), both sides of the workpiece are grasped as mentioned above and then a peripheral edge of the front side to be formed is grasped by the blank holder when the spare tire pan is formed. Specifically, the peripheral edge of the front side of the workpiece is grasped by the first front pad 33 and the first front holder 24, the second front pad 34 and the second front holder 25, and the third front pad 35 and the third front holder 26.

FIG. 7 (C) is a perspective view of the workpiece when a convex-concave extending in a vehicle width direction between the spare tire pan and a front side thereof is formed. As illustrated in FIG. 7 (C), the steel plate 10 is pressed by the punch 31 in a state where both sides of the rear side of the steel plate and the peripheral edge of the front side thereof are grasped. In this way, the convex-concave extending in a vehicle width direction between the spare tire pan and a front side thereof is formed.

FIG. 7 (D) is a perspective view of the workpiece when a convex part extending in the front and rear directions of a vehicle body is formed on an upper surface of the spare tire pan. As illustrated in FIG. 7 (D), both sides of the rear side of the steel plate 10 and the peripheral edge of the front side thereof are grasped and then a peripheral edge of the rear side of the spare tire pan to be formed is grasped by the blank holder. Specifically, the peripheral edge of the rear side of the spare tire pan is grasped by the rear pad 32 and the die 21. In this way, the convex part extending in the front and rear directions of the vehicle body is formed on an upper surface of the spare tire pan.

In this way, the rear floor panel 100 (see, FIG. 1) is formed, which includes the spare tire pan 110 provided on the rear side thereof and the convex-concave extending in a vehicle width direction between the spare tire pan 110 and a front side thereof.

Next, an operation of the press-forming apparatus 1 according to the present embodiment will be described by referring to FIGS. 8 to 12. FIGS. 8 to 12 respectively illustrate a sectional view of the press-forming apparatus 1 during forming, taken along line A-A and line B-B of FIG. 2.

Figure 8:
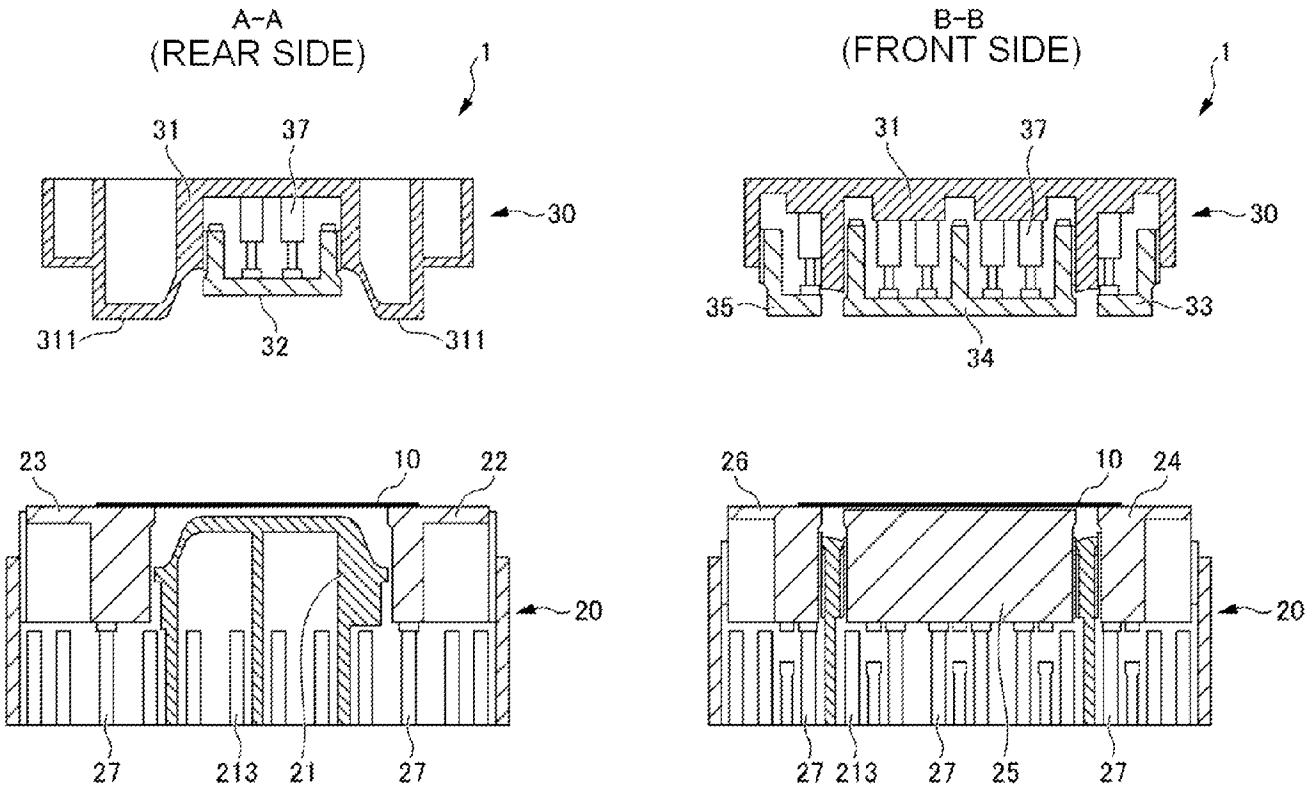
FIG. 8 is a longitudinal sectional view illustrating the press-forming apparatus according to the above embodiment when an upper die mechanism is located in the top dead center.

FIG. 8 is a longitudinal sectional view illustrating the press-forming apparatus 1 when the upper die mechanism 30 is located in the top dead center. As illustrated in FIG. 8, first, the steel plate 10 is set on the lower die mechanism 20. Specifically, the steel plate 10 is supported on the first side holder 22 and the second side holder 23, and the first front holder 24 and the third front holder 26. At this time, the uppermost surface of the die 21 is located at a position lower than the upper surface of each holder. Further, the leading end surface of the rear pad 32 and each front pad is located at a position higher than leading end surfaces 311 of both sides of the punch 31.

Figure 9:
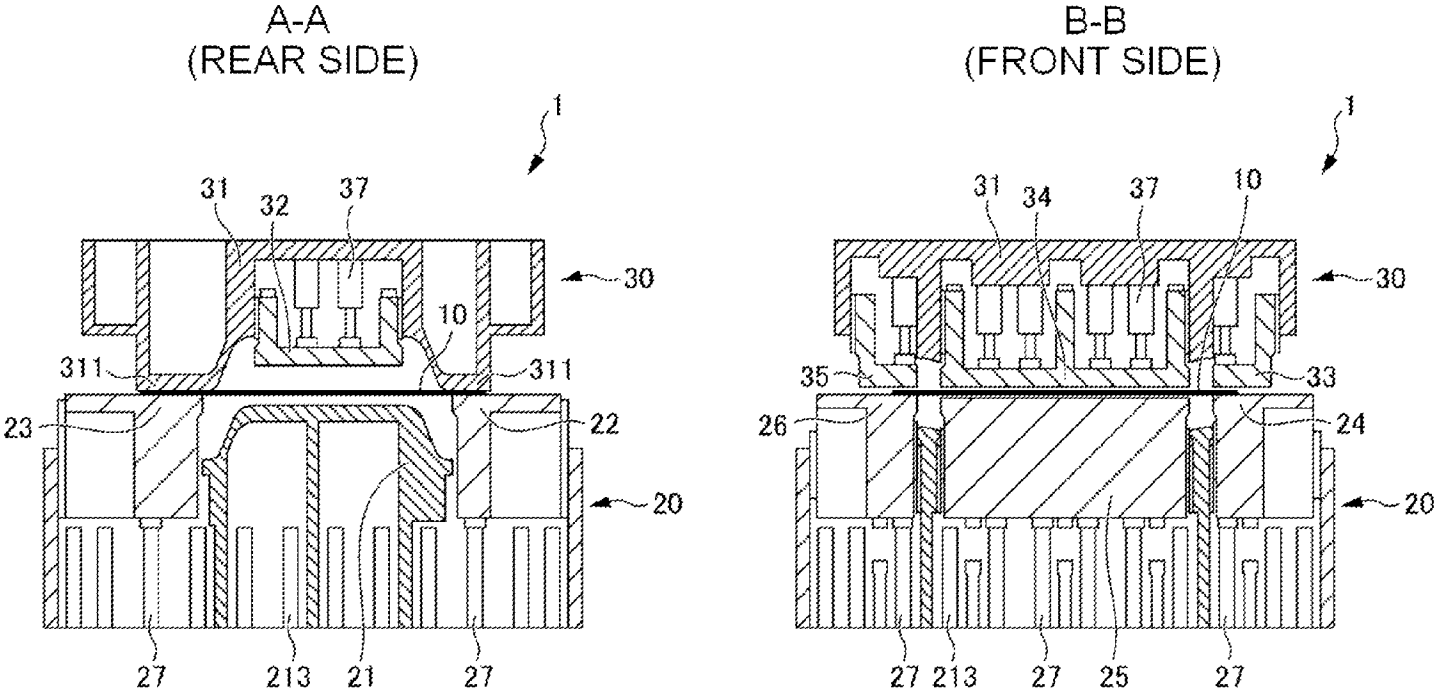
FIG. 9 is a longitudinal sectional view illustrating the press-forming apparatus according to the above embodiment when both sides of the rear side of the workpiece are grasped.

FIG. 9 is a longitudinal sectional view illustrating the press-forming apparatus 1 when both sides of the rear side of the steel plate 10 are grasped. As illustrated in FIG. 9, as the upper die mechanism 30 is lowered, the leading end surface 311 of both sides of the punch 31 is first brought into contact with both ends of the steel plate 10. Thereby, both sides of the rear side of the steel plate 10 are grasped by the punch 31 and the first side holder 22, and the punch and the second side holder 23. At this time, the peripheral edge of the front side of the steel plate 10 is not yet grasped.

Figure 10:
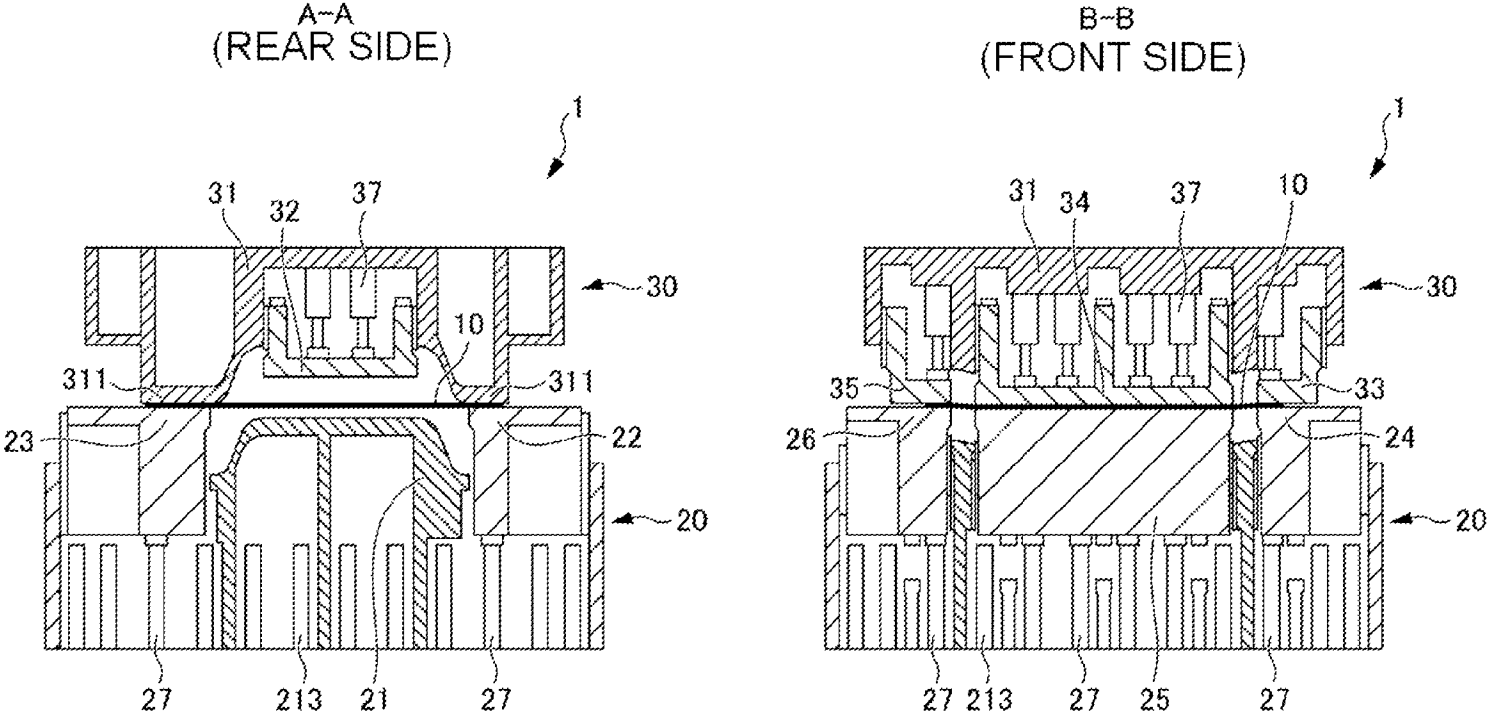
FIG. 10 is a longitudinal sectional view illustrating the press-forming apparatus according to the above embodiment when a front peripheral edge of the workpiece is grasped.

FIG. 10 is a longitudinal sectional view illustrating the press-forming apparatus 1 when a peripheral edge of the front side of the steel plate 10 is grasped. As illustrated in FIG. 10, as the upper die mechanism 30 is further lowered, the leading end surface of each front pad is brought into contact with the steel plate 10. Thereby, the peripheral edge of the front side of the steel plate 10 is grasped by each front pad and each front holder.

Figure 11:
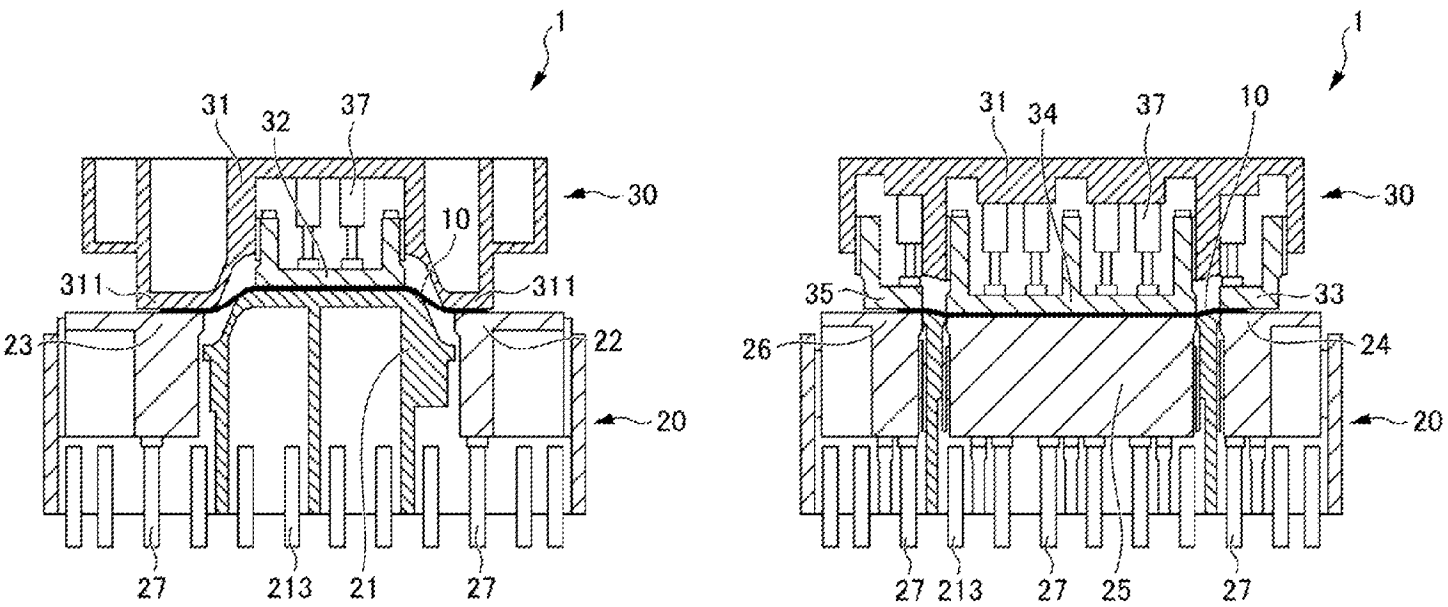
FIG. 11 is a longitudinal sectional view illustrating the press-forming apparatus according to the above embodiment when a rear peripheral edge of the workpiece is grasped.

FIG. 11 is a longitudinal sectional view illustrating the press-forming apparatus 1 when a peripheral edge of the rear side of the steel plate 10 is grasped. As illustrated in FIG. 11, as the upper die mechanism 30 is further lowered, each side holder is lowered relative to the die 21. As a result, the steel plate 10 is pressed upward by the die 21. In this way, the spare tire pan is formed on the rear side of the steel plate. At this time, since the stroke length of each front holder is set shorter than the stroke length of each side holder, each front holder cannot be further lowered by stoppers which are separately provided.

Figure 12:
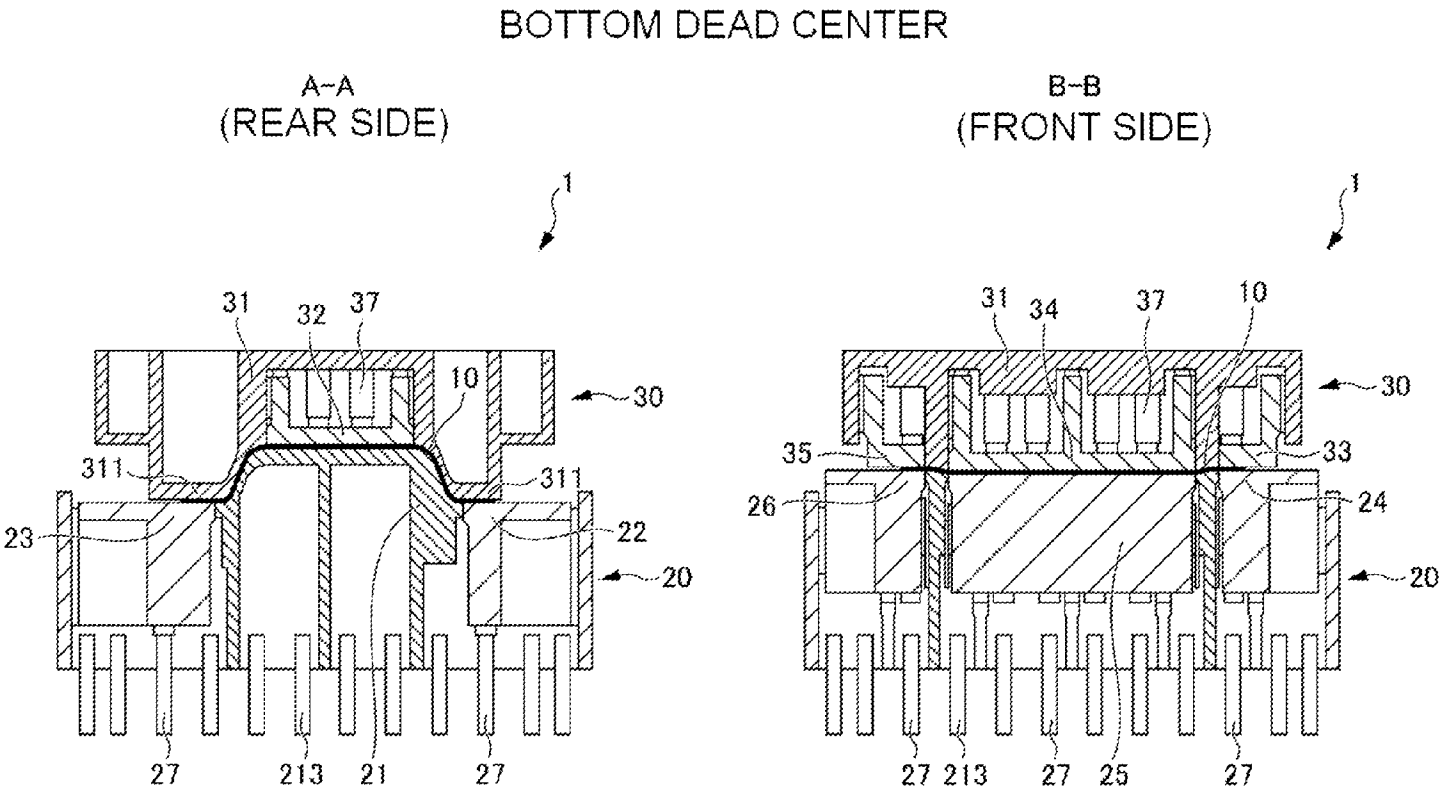
FIG. 12 is a longitudinal sectional view illustrating the press-forming apparatus according to the above embodiment when the upper die mechanism reaches a bottom dead center.

FIG. 12 is a longitudinal sectional view illustrating the press-forming apparatus 1 when the upper die mechanism 30 reaches a bottom dead center. As illustrated in FIG. 12, as the upper die mechanism 30 is further lowered to reach the bottom dead center, each side holder is further lowered relative to the die 21 and thus the steel plate 10 is further pressed upward by the die 21. In this way, a spare tire pan is formed on the rear side thereof. Further, at this time, each front holder reaches its stroke limit and thus is not further lowered, as mentioned above. Accordingly, it is found that the peripheral edge of the front side of the steel plate 10 is located at a position higher than both sides of the steel plate 10. Thereby, the rear peripheral edge is formed while being pressed and restrained at a vertical position different from the front peripheral edge. Accordingly, a waste-margin of the rear peripheral edge is reduced.

According to the press-forming apparatus 1 and the press-forming method of the embodiment, there are advantages as follows.

In the present embodiment, a draw-forming is carried out while grasping a plurality of portions of the steel plate 10 by the blank holder (each side holder, each front holder, the rear pad 32 and each front pad) at timings different from each other depending on the forming shapes thereof. Thereby, the blank holder can grasp the plurality of portions of the steel plate 10 at suitable different timings depending on the stepped shapes when the rear floor panel 100 having a plurality of stepped shapes is draw-formed. Accordingly, according to the present embodiment, the draw-forming can be carried out in a high precision while suppressing occurrence of wrinkles, even in a case of having a plurality of stepped parts. On this account, it is possible to reduce waste-margin and improve the yield of material.

Further, according to the present embodiment, since a plurality of portions of the steel plate 10 is grasped by the blank holder at timings different from each other, it is possible to shorten the stroke length of the blank holder grasping at a later timing. Accordingly, increase in the size of the die-assembly can be avoided.

Further, in the present embodiment, a plurality of convex-concave shapes are formed at timings different from each other during one stroke. And, surroundings of the portions formed into the convex-concave shapes are grasped by the blank holder depending on the forming sequences thereof during the forming. That is, when the rear floor panel 100 having a plurality of stepped shapes is draw-formed, surroundings of the formed portions are grasped by the blank holder depending on the forming sequences of the stepped shapes. In this way, a plurality of portions of the steel plates 10 can be grasped by the blank holder at a suitable different timing. Accordingly, it is possible to further improve the above effects.

In addition, in the present embodiment, the rear floor panel 100 includes the spare tire pan 110 provided on the rear side thereof and the convex-concave 120 extending in a vehicle width direction between the spare tire pan 110 and the front side thereof. When the rear floor panel 100 is draw-formed, both ends of the spare tire pan 110 in the vehicle width direction, a front peripheral edge and a rear peripheral edge of the spare tire pan 110 are grasped in this order by the blank holder. Accordingly, it is possible to form the rear floor panel 100 having a plurality of stepped shapes while achieving the above effects.

The present invention is not limited to the above embodiment and the above embodiment can be variously modified and changed without departing from the spirit and scope of the invention.

In accordance with the above embodiment and modification, a press-formed product (100) may be manufactured by press-forming a workpiece (10) in a single stroke by a punch (31) and a die (21). The manufacturing method may include a process of grasping a first portion of the workpiece (10) by a blank holder at a first timing in the single stroke, and a process of grasping a second portion of the workpiece (10) which is different from the first portion by the blank holder at a second timing in the single stroke which is different from the first timing.

Moreover, in accordance with the above embodiment and modification, in a press-forming method for forming a workpiece (10) by a punch (31) and a die (21) in a state where the workpiece (10) is grasped by a blank holder (22, 23, 24, 25, 26, 32, 33, 34, 35), the method may include a process of grasping a plurality of portions of the workpiece (10) by the blank holder at timings different from each other depending on forming shapes thereof during forming.

According to this method, a draw-forming is carried out while grasping a plurality of portions of the workpiece by the blank holder at timings different from each other depending on the forming shapes thereof. Thereby, the blank holder can grasp the plurality of portions of the workpiece at suitable different timings depending on the stepped shapes when a rear floor panel having a plurality of stepped shapes is draw-formed. Accordingly, the draw-forming can be carried out in a high precision while suppressing occurrence of wrinkles, even in a case of having a plurality of stepped parts. On this account, it is possible to reduce waste margin and improve the yield of material.

In addition, since a plurality of portions of the workpiece is grasped by the blank holder at timings different from each other, it is possible to shorten the stroke length of the blank holder grasping at a later timing. Accordingly, increase in the size of the die-assembly can be avoided.

The above method may further includes a process of forming a plurality of convex-concave shapes at timings different from each other in a single stroke; and a process of grasping peripheral parts of the workpiece that surround parts to be formed into the convex-concave shapes by the blank holder depending on the forming sequences thereof during forming.

According to this method, a plurality of convex-concave shapes is formed at timings different from each other during the single stroke. The peripheral parts that surround the parts to be the convex-concave shapes are grasped by the blank holder depending on the forming sequences thereof during the forming. That is, when the rear floor panel having a plurality of stepped shapes is draw-formed, surroundings of the formed portions are grasped by the blank holder depending on the forming sequences of the stepped shapes. In this way, a plurality of portions of the workpiece can be grasped by the blank holder at a suitable different timing. Accordingly, it is possible to further improve the above effects.

In the above method, wherein the workpiece (10) may be formed into a lower structure (100) of a vehicle body which includes a spare tire pan (110) and a convex-concave (120), the spare tire pan (110) is provided on a rear side and the convex-concave (120) is provided on a front side and extends in a vehicle width direction. The above method may further includes a process of grasping both ends in the vehicle width direction of the spare tire pan (110), a front peripheral edge and a rear peripheral edge of the spare tire pan (110) in this order by the blank holder during forming.

According to this method, when draw-forming a lower structure of a vehicle body which includes the spare tire pan provided on the rear side thereof and the convex-concave extending in a vehicle width direction between the spare tire pan and the front side thereof, both ends of the spare tire pan in the vehicle width direction, a front peripheral edge and a rear peripheral edge of the spare tire pan are grasped in this order by the blank holder. Accordingly, it is possible to form the rear floor panel having a plurality of stepped shapes while achieving the above effects.

Furthermore, in accordance with the above embodiment and modification, a press-forming apparatus (1) may include a punch (31), a die (21) and a blank holder (22, 23, 24, 25, 26, 32, 33, 34, 35) adapted to grasp a workpiece (10). The blank holder may be divided into a plurality of parts and supported by a cushion (37). At least one of the divided parts of the blank holder may be supported to grasp the workpiece at a timing which is different from a timing that another of the divided parts of the blank holder grasps the workpiece.

In the above apparatus, a stroke length of at least one of the divided parts of the blank holder may be different from a stroke length of another of the divided parts of the blank holders.

According to the embodiment, it is possible to provide a press-forming apparatus and a press-forming method capable of forming a shape having a plurality of stepped portions therein while avoiding increase in the size of the die-assembly and improving the yield of material by reducing a waste-margin.

What is claimed is:

1. A press-forming apparatus comprising:

a punch;

a die;

a blank holder adapted to grasp a workpiece; and an upper die mechanism which includes an upper die blank holder supported by a gas spring, wherein the blank holder is divided into a plurality of parts and supported by a cushion, and wherein at least one of the divided parts of the blank holder is supported to grasp the workpiece at a timing which is different from a timing that another of the divided parts of the blank holder grasps the workpiece, and wherein the gas spring comprises:

a cylinder, a piston rod which has a circumferential groove on an outer peripheral surface of a leading end, an annular plate which is fixed to the upper die blank holder and which has a groove at an approximately central portion in a vertical direction, and a retainer ring disposed between the groove of the annular plate and the groove of the piston rod, wherein a lifting load is transmitted to the upper die blank holder via the annular plate and the retainer ring at the time of lifting the upper die mechanism, and wherein the retainer ring is composed of two parts and the groove of the annular plate is formed so as to the both of the two parts can be slidably inserted.

2. The apparatus according to claim 1, wherein a stroke length of at least one of the divided parts of the blank holder is different from a stroke length of another of the divided parts of the blank holders.

* * * * *